US005759965A

United States Patent [19]

Sumiejski

[11] Patent Number: 5,759,965

[45] Date of Patent: Jun. 2, 1998

[54] ANTIWEAR ENHANCING COMPOSITION FOR LUBRICANTS AND FUNCTIONAL FLUIDS

[75] Inventor: James L. Sumiejski, Mentor, Ohio

[73] Assignee: The Lubrizol Corporation, Wickliffe, Ohio

[21] Appl. No.: 730,796

[22] Filed: Oct. 17, 1996

Related U.S. Application Data

[63] Continuation-in-part of Ser. No. 682,217, Jul. 17, 1996, abandoned, which is a continuation-in-part of Ser. No. 544,793, Oct. 18, 1995, abandoned.

[51] Int. Cl.[6] ..... C10M 141/12; C10M 141/10

[52] U.S. Cl. ..... 508/186; 508/195; 508/199; 508/433; 508/444

[58] Field of Search ..... 508/186, 195, 508/199, 444, 433

[56] References Cited

U.S. PATENT DOCUMENTS

| | | | |
|---|---|---|---|
| 3,723,315 | 3/1973 | Sullivan | 508/433 |
| 3,780,145 | 12/1973 | Malec | 508/433 |
| 3,833,496 | 9/1974 | Malec | 508/444 |
| 3,890,363 | 6/1975 | Malec | 508/444 |
| 4,584,115 | 4/1986 | Davis | 508/199 |
| 4,609,480 | 9/1986 | Hata et al. | 508/444 |
| 4,755,311 | 7/1988 | Burjes et al. | 508/188 |
| 4,758,362 | 7/1988 | Butke | 508/229 |
| 4,792,410 | 12/1988 | Schwind et al. | 508/186 |
| 4,997,969 | 3/1991 | Luciani | 508/444 |
| 5,387,346 | 2/1995 | Hartley et al. | 508/287 |
| 5,403,501 | 4/1995 | Schwind | 508/186 |
| 5,561,103 | 10/1996 | Tipton | 508/444 |
| 5,629,272 | 5/1997 | Nakazato et al. | 508/199 |
| 5,635,459 | 6/1997 | Stoffa et al. | 508/186 |
| 5,703,023 | 12/1997 | Srinivasan | 508/468 |

*Primary Examiner*—Ellen M. McAvoy
*Attorney, Agent, or Firm*—David M. Shold; William J. Connors

[57] ABSTRACT

This invention relates to a composition, comprising: (A) a boron-containing overbased material; (B) a phosphorus acid, ester or derivative thereof; and (C) a borated epoxide or borated fatty acid ester of glycerol. In one embodiment the inventive composition further comprises (D) a thiocarbamate. These compositions are useful in providing lubricants and functional fluids, particularly automatic transmission fluids, with enhanced antiwear properties. In one embodiment these compositions also provide such lubricants and functional fluids with enhanced extreme-pressure and/or friction-modifying.

16 Claims, No Drawings

ANTIWEAR ENHANCING COMPOSITION FOR LUBRICANTS AND FUNCTIONAL FLUIDS

This is a continuation-in-part of application Ser. No. 08/682,217 filed Jul. 17, 1996 now abandoned, which is a continuation-in-part of Ser. No. 08/544,793 filed Oct. 18, 1995, now abandoned.

TECHNICAL FIELD

This invention relates to additive compositions that are useful for enhancing the antiwear properties of lubricants and functional fluids, especially automatic transmission fluids.

BACKGROUND OF THE INVENTION

This is a continuing demand in the automotive and truck markets for automatic transmissions that can operate under more severe conditions and for longer periods of time than was previously acceptable. The automatic transmissions that meet these standards require improved automatic transmission fluids that are characterized by enhanced antiwear properties. The present invention fulfills this need.

SUMMARY OF THE INVENTION

This invention relates to a composition, comprising: (A) a boron-containing overbased material; (B) a phosphorus acid, ester or derivative thereof; and (C) a borated epoxide or borated fatty acid ester of glycerol. In one embodiment, the inventive composition further comprises (D) a thiocarbarnate. These compositions are useful in providing lubricants and functional fluids, particularly automatic transmission fluids, with enhanced antiwear properties. In one embodiment these compositions also provide such lubricants and functional fluids with enhanced extreme-pressure and/or friction-modifying properties.

DESCRIPTION OF THE PREFERRED EMBODIMENTS

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based", "aryl-based", and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

(A) BORON-CONTAINING OVERBASED MATERIAL

Overbased products are metal salts or complexes characterized by a metal content in excess of that which would be present according to the stoichiometry of the metal and the particular acidic organic compound reacted with the metal, e.g., a sulfonic acid. The term "metal ratio" is used herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant (e.g., calcium hydroxide, barium oxide, etc.) according to the known chemical reactivity and stoichiometry of the two reactants.

The boron-containing overbased material (A) of this invention typically has a metal ratio in excess of 1 and generally up to about 40 or more. In one embodiment, the metal ratio for component (A) is from an excess of 1 up to about 35, and in one embodiment from an excess of 1 up to about 30. The metal ratio generally ranges from about 1.1 or about 1.5 to about 40, and in one embodiment about 1.1 or about 1.5 to about 35, and in one embodiment about 1.1 or about 1.5 to about 30, and in one embodiment about 1.1 or about 1.5 to about 26. In one embodiment the metal ratio is from about 1.5 to about 30, and in one embodiment about 6 to about 30, and in one embodiment about 10 to about 30, and in one embodiment about 15 to about 30. In one embodiment, the metal ratio is from about 20 to about 30. Here, as well as throughout the specification, the range and ratio limits may be combined.

In one embodiment, the borated overbased material (A) is prepared by first preparing an overbased material then contacting that overbased material with at least one boron compound. The overbased material is prepared by contacting a reaction mixture comprising at least one organic material to be overbased, a reaction medium consisting essentially of at least one inert, organic solvent/diluent for said organic material to be overbased, a stoichiometric excess of at least one metal base and at least one promoter, with at least one acidic material. Methods for preparing the overbased materials as well as an extremely diverse group of overbased materials are well known in the prior art and are disclosed, for example in the following U.S. Pat. No. 3,492,231, which is incorporated herein by reference.

The organic material to be overbased is generally at least one carboxylic acid, sulfur-containing acid, phosphorus-containing acid, hydroxyaromatic compound, precursor of any of the foregoing compounds, or mixture of two or more of any of the foregoing compounds or precursors.

Carboxylic Acids

The carboxylic acids useful as the organic material to be overbased may be aliphatic or aromatic, mono- or polycarboxylic acid or acid-producing compounds. Throughout this specification and in the appended claims, any reference to carboxylic acids is intended to include the acid-producing derivatives thereof such as anhydrides, esters, (lower, e.g. $C_{1-8}$, alkyl esters), acyl halides, lactones and mixtures thereof unless otherwise specifically stated.

These carboxylic acids can have at least about 8, or at least about 12 carbon atoms, or at least about 16 carbon atoms, or at least about 20 carbon atoms, or at least about 30 carbon atoms, or at least about 50 carbon atoms. Generally, these carboxylic acids do not contain more than about 400 or about 500 carbon atoms per molecule.

The monocarboxylic acids contemplated herein include saturated and unsaturated acids. The monocarboxylic acids include fatty acids having from about 8 to about 30, or from about 10 to about 24 carbon atoms. Examples of such useful monocarboxylic acids include dodecanoic acid, palmitic acid, decanoic acid, oleic acid, lauric acid, stearic acid, myristic acid, linoleic acid, linolenic acid, naphthenic acid, chlorostearic acid, tall oil acid, etc. Anhydrides and lower alkyl esters of these acids can also be used. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference.

The monocarboxylic acids include isoaliphatic acids, i.e., acids having one or more lower acyclic pendant alkyl groups. Such acids often contain a principal chain having from about 14 to about 20 saturated, aliphatic carbon atoms and at least one but usually no more than about four pendant acyclic alkyl groups. The principal chain of the acid is exemplified by groups derived from tetradecane, pentadecane, hexadecane, heptadecane, octadecane, and eicosane. The pendant group is preferably a lower alkyl group such as methyl, ethyl, n-propyl, isopropyl, n-butyl, isobutyl, tert-butyl, n-hexyl, or other groups having up to about 7 carbon atoms. The pendant group may also be a polar-substituted alkyl group such as chloromethyl, bromobutyl, methoxyethyl, or the like, but it preferably contains no more than one polar substituent per group. Specific examples of such isoaliphatic acids include 11-methyl-pentadecanoic acid, 3-ethyl-hexadecanoic acid, 6-methyl-octadecanoic acid, 16-methyl-octadecanoic acid, 15-ethyl-heptadecanoic acid, 3-chloromethyl-nonadecanoic acid, 7,8,9,10-tetramethyl-octadecanoic acid, and 2,9,10-trimethyloctadecanoic acid.

The isoaliphatic acids include mixtures of branch-chain acids prepared by the isomerization of commercial fatty acids of, for example, about 16 to about 20 carbon atoms. A useful method involves heating the fatty acid at a temperature above about 250° C. and a pressure between about 200 and 700 psi, distilling the crude isomerized acid, and hydrogenating the distillate to produce a substantially saturated isomerized acid. The isomerization can be promoted by a catalyst such as mineral clay, diatomaceous earth, aluminum chloride, zinc chloride, ferric chloride, or some other Friedel-Crafts catalyst. The concentration of the catalyst may be as low as about 0.01%, but more often from about 0.1% to about 3% by weight of the isomerization mixture. Water also promotes the isomerization and a small amount, from about 0.1% to about 5% by weight, of water may thus be advantageously added to the isomerization mixture. The unsaturated fatty acids from which the isoaliphatic acids may be derived include oleic acid, linoleic acid, linolenic acid, and commercial fatty acid mixtures such as tall oil acids.

In one embodiment the carboxylic acid is at least one hydrocarbyl-substituted carboxylic acid or anhydride. In one embodiment, the hydrocarbyl group has at least about 8 carbon atoms up to about 400, preferably at least about 12 to about 300, more preferably at least about 16 to about 200 carbon atoms. In one embodiment, the hydrocarbyl substituted carboxylic acid or anhydride is derived from the reaction of an unsaturated carboxylic reagent and a polyalkene. The unsaturated carboxylic reagent includes mono, di, tri or tetracarboxylic reagents. Specific examples of useful mono-basic unsaturated carboxylic acids are acrylic acid, methacrylic acid, cinnamic acid, crotonic acid, 2-phenylpropenoic acid, and lower alkyl esters thereof. Exemplary polybasic acids include maleic acid, maleic anhydride, fumaric acid, mesaconic acid, itaconic acid and citraconic acid. Generally, the unsaturated carboxylic reagent is maleic anhydride, acid or lower ester, e.g. those containing less than eight carbon atoms.

The polyalkenes include homopolymers and interpolymers of olefins having from 2 to about 20 carbon atoms. The olefins include ethylene, propylene, 1-butene, isobutylene, 2-pentene, 2-methyl-1-butene, 3-methyl-1-butene, 1-hexene, 1-heptene, 1-octene, styrene, 1-nonene, 1-decene, 1-undecene, 1-dodecene, 1-tridecene, 1-tetradecene, 1-pentadecene, 1-hexadecene, 1-heptadecene and 1-octadecene. Higher olefin mixtures such as olefins in the range of about 18 to about 24 carbon atoms can be used. The hydrocarbyl group, R, can be derived from at least one alpha-olefin fraction selected from the group consisting of $C_{15-18}$ alpha-olefins, $C_{12-16}$ alpha-olefins, $C_{14-16}$ alpha-olefins, $C_{14-18}$ alpha-olefins and $C_{16-18}$ alpha-olefins. In one embodiment, R is an alkyl or an alkenyl group. Examples of polyalkenes include polybutene, polyisobutylene, ethylene-propylene copolymer, polypropylene, and mixtures of two or more of any of these. Included in this group are those derived from polybutene in which at least about 50% of the total units derived from butenes is derived from isobutylene.

In one embodiment, the polyalkene is characterized by an Mn (number average molecular weight) of at least about 200 or at least about 400. Generally, the polyalkene is characterized by having an Mn from about 500 up to about 5000, or from about 700 up to about 3000, or from about 800 up to 2500, or from about 900 up to about 2000. In another embodiment, Mn varies from about 500 up to about 1500, or from about 700 up to about 1300, or from about 800 up to about 1200. In another embodiment, the polyalkenes have an Mn from about 1300 up to about 5000, or from about 1500 up to about 4500, or from about 1700 up to about 3000. In one embodiment, the polyalkenes have an Mw/Mn from about 1 to about 10, or from about 1.5 to about 5, or from about 2.5 to about 4.

In another embodiment, the acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least 0.9. The maximum number will generally not exceed 4.5. A suitable range is from about 1.3 to 3.5 and or from about 1.5 to about 2.5 succinic groups per equivalent weight of substituent groups.

In one embodiment, the carboxylic acid is at least one substituted succinic acid or anhydride, said substituted succinic acid or anhydride has a polybutenyl group characterized by an Mn value of about 1500 to about 2000 and an Mw/Mn value of about 3 to about 4. These acids or anhydrides are characterized by the presence within their structure of an average of about 1.5 to about 2.5 succinic groups for each equivalent weight of substituent groups. In another embodiment, the carboxylic acid or anhydrideis a polybutenyl succinc anhydride wherein the polybutenyl group has an Mn value of about 800 to about 1200; an Mw/Mn value of about 2 to about 3; and is characterized by the presence within their structure of an average of about 0.9 to about 1.2 succinic groups for each equivalent weight of substituent groups.

Hydrocarbyl-substituted carboxylic acids suitable for use as the organic material to be overbased are described in detail in the following U.S. Patents: U.S. Pat. Nos. 3,219,666; and 4,234,435. These patents are incorporated herein by reference.

A useful group of carboxylic acids are the aromatic carboxylic acids. These acids can be represented by the formula

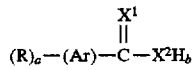

(I)

wherein R is an aliphatic hydrocarbyl group of preferably about 4 to about 400 carbon atoms, a is a number in the range of zero to about 4, Ar is an aromatic group, $X^1$ and $X^2$ are independently sulfur or oxygen, and b is a number in the range of from 1 to about 4, with the proviso that the sum of a and b does not exceed the number of unsatisfied valences of Ar. Preferably, R and a are such that there is an average of at least about 8 aliphatic carbon atoms provided by the R groups. The aromatic groups Ar that are useful include the polyvalent aromatic groups derived from benzene, naphthalene, anthracene, phenanthrene, indene, fluorene, biphenyl, and the like. Generally, the Ar groups used herein are polyvalent nuclei derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc. These Ar groups may contain non-hydrocarbon substituents, for example, such diverse substituents as lower alkoxy, lower alkyl mercapto, nitro, halo, alkyl or alkenyl groups of less than about 4 carbon atoms, hydroxy, mercapto, and the like. Examples of the R groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylene-propylene copolymers, and the like.

A group of useful carboxylic acids are those of the formula

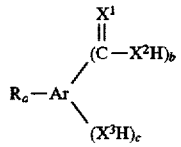

wherein R, Ar, $X^1$, $X^2$, a and b are as defined in Formula I, $X^3$ is oxygen or sulfur, and c is a number in the range of 1 to about 4, usually 1 to about 2, with the proviso that the sum of a, b and c does not exceed the unsatisfied valences of Ar. Within this group are the carboxylic acids of the formula

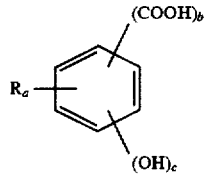

wherein R is an aliphatic hydrocarbyl group preferably containing from about 4 to about 400 carbon atoms, a is a number in the range of from zero to about 4, preferably 1 to about 3; b is a number in the range of 1 to about 4, preferably 1 to about 2, c is a number in the range of 1 to about 4, preferably 1 to about 2, and more preferably 1; with the proviso that the sum of a, b and c does not exceed 6. Preferably, R and a are such that the acid molecules contain at least an average of about 12 aliphatic carbon atoms in the aliphatic hydrocarbon substituents per acid molecule. Also useful are the aliphatic hydrocarbon-substituted salicylic acids wherein each aliphatic hydrocarbon substituent contains an average of at least about 8 carbon atoms per substituent and 1 to 3 substituents per molecule. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms are particularly useful. The aromatic carboxylic acids corresponding to the above formulae are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791, which are incorporated herein by reference.

Sulfur-Containing Acids

The sulfur-containing acids include the sulfonic, sulfamic, thiosulfonic, sulfinic, sulfenic, partial ester sulfuric, sulfurous and thiosulfuric acids. The sulfonic acids include the mono- or polynuclear aromatic or cycloaliphatic compounds. The sulfonic acids and sulfonates can be represented for the most part by the following formulae:

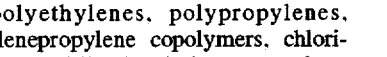

$$(R^1{}_a\text{—}T\text{—}(SO_3)_b)_cM_d$$

or

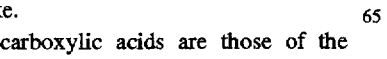

$$(R^2\text{—}(SO_3)_b)_cM_d$$

In the above formulae, T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc.; $R^1$ is an aliphatic group such as alkyl, alkenyl, alkoxy, alkoxyalkyl, carboalkoxyalkyl, etc.; a is at least 1, and $R^1_a$+T contains a total of at least about 15 carbon atoms. $R^2$ is an aliphatic hydrocarbyl group containing at least about 15 carbon atoms. Examples of $R^2$ are alkyl, alkenyl, alkoxyalkyl, carboalkoxyalkyl, etc. Specific examples of $R^2$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$, and $R^2$ in the above formulae can also contain other inorganic or organic substituents in addition to those enumerated above such as, for example, hydroxy, mercapto, halogen, nitro, amino, nitroso, sulfide, disulfide, etc. M is hydrogen or a metal cation (e.g., alkli or alkaline earth metal), and a, b, c and d are each at least 1.

The following oil-soluble sulfonic acids are useful: mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, dicapryl nitronaphthalene sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates LAS) are also useful in making the sulfonates used in this invention.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

Phosphorus-Containing Acids

The phosphorus-containing acids can be represented by the formula

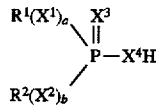

wherein $X^1$, $X^2$, $X^3$ and $X^4$ are independently O, S or $NR^3$ wherein $R^3$ is hydrogen or a hydrocarbyl group, preferably hydrogen or a lower alkyl group; a and b are independently zero or one, and $R^1$ and $R^2$ are independently hydrogen or hydrocarbyl groups. These phosphorus-containing acids include the phosphorus- and sulfur-containing acids. They include those acids wherein at least one $X^3$ or $X^4$ is sulfur, and more preferably both $X^3$ and $X^4$ are sulfur, at least one $X^1$ or $X^2$ is oxygen or sulfur, more preferably both $X^1$ and $X^2$ are oxygen, and a and b are each 1. Mixtures of these acids may be employed in accordance with this invention. $R^1$ and $R^2$ are independently hydrogen or hydrocarbyl groups that are preferably free from acetylenic unsaturation and usually also from ethylenic unsaturation. The total number of carbon atoms in $R^1$ and $R^2$ must be sufficient to render the compound soluble in the reaction medium. Generally this total is at least about 8 carbon atoms, and in one embodiment at least about 12 carbon atoms, and in one embodiment at least about 16 carbon atoms, and in one embodiment at least about 20 carbon atoms. In one embodiment, $R^1$ and $R^2$ independently have up to about 400 or about 500 carbon atoms. Each $R^1$ and $R^2$ can be the same as the other, although they may be different and either or both may be mixtures. Examples of useful $R^1$ and $R^2$ groups include t-butyl, isobutyl, amyl, isooctyl, decyl, dodecyl, eicosyl, dodecenyl, naphthyl, alkylphenyl, alkylnaphthyl, phenylalkyl, naphthyalkyl, alkylphenylalkyl, alkylynaphthylalkyl, and the like.

The phosphorus-containing acids can be at least one phosphate, phosphonate, phosphinate or phosphine oxide. These pentavalent phosphorus derivatives can be represented by the formula

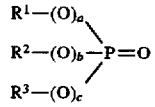

wherein $R^1$, $R^2$ and $R^3$ are independently hydrocarbyl groups, or hydrogen and a, b and c are independently zero or 1. The phosphorus-containing acid can be at least one phosphite, phosphonite, phosphinite or phosphine. These trivalent phosphorus derivatives can be represented by the formula

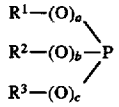

wherein $R^1$, $R^2$ and $R^3$ are independently hydrocarbyl groups, and a, b and c are independently zero or 1. The total number of carbon atoms in $R^1$, $R^2$ and $R^3$ in each of the above formulae must be sufficient to render the compound soluble in the reaction medium. Generally, the total number of carbon atoms in $R^1$, $R^2$ and $R^3$ is at least about 8, and in one embodiment at least about 12, and in one embodiment at least about 16. There is no limit to the total number of carbon atoms in $R^1$, $R^2$ and $R^3$ that is required, but a practical upper limit is about 400 or about 500 carbon atoms. In one embodiment, $R^1$, $R^2$ and $R^3$ in each of the above formulae are independently hydrocarbyl groups of preferably 1 to about 100 carbon atoms, or 1 to about 50 carbon atoms, or 1 to about 30 carbon atoms, with the proviso that the total number of carbons is at least about 8. Each $R^1$, $R^2$ and $R^3$ can be the same as the other, although they may be different. Examples of useful $R^1$, $R^2$ and $R^3$ groups include hydrogen, t-butyl, oisobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylakyl, and the like.

In another embodiment, the phosphorus acid is characterized by at least one direct carbon-to-phosphorus linkage such as those prepared by the treatment of an olefin polymer, such as one or more of the above polyalkenes (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

Hydroxyaromatic Compounds

The organic material to be overbased can be at least one hydroxyaromatic compound represented by the formula: $R_a$—Ar—$(XH)_b$, wherein R is an aliphatic hydrocarbyl group of generally about 4 to about 400 carbon atoms; Ar is an aromatic group; X is O, S, $CH_2O$ or $CH_2NR^1$, wherein $R^1$ is hydrogen or a hydrocarbyl group (preferably alkyl or alkenyl) of generally 1 to about 30 carbon atoms, and in one embodiment 1 to about 20 carbon atoms, and in one embodiment 1 to about 10 carbon atoms; a and b are independently numbers of at least one, the sum of a and b being in the range of two up to the number of displaceable hydrogens on the aromatic nucleus or nuclei of Ar. Generally, a and b are independently numbers in the range of 1 to about 4, and in one embodiment 1 to about 2. R and a are such that there is a sufficient number of aliphatic carbon atoms in the R groups to render the compound soluble in the reaction medium. Generally, there is an average of at least about 8 aliphatic carbon atoms, and in one embodiment at least about 12 carbon atoms, provided by the R groups.

In one embodiment, X is O and the functionally-substituted aromatic compound is a phenol. With such phenols, however, it is to be understood that the aromatic group Ar is not a limited benzene, as discussed below.

The R group is a hydrocarbyl group that is directly bonded to the aromatic group Ar. R generally contains about 6 to about 80 carbon atoms, and in one embodiment about 6 to about 30 carbon atoms, and in one embodiment about 8 to about 25 carbon atoms, and advantageously about 8 to about 15 carbon atoms. Examples of R groups include butyl, isobutyl, pentyl, octyl, nonyl, dodecyl, dodecosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, propylene tetramer and tri(isobutene). In one embodiment, R is a hydrocarbyl group as defined above for caboxylic acids.

As will be appreciated from inspection of the above formula, these compounds contain at least one R group, as defined above, and at least one functional group XH. Each of the foregoing must be attached to a carbon atom which is a part of an aromatic nucleus in the Ar group. They need not, however, each be attached to the same aromatic ring if more than one aromatic nucleus is present in the Ar group.

It is to be understood that the aromatic group as represented by "Ar" in the above formula, as well as elsewhere in other formulae in this specification and in the appended claims, can be mononuclear such as a phenyl, a pyridyl, a thienyl, or polynuclear. The polynuclear groups can be of the fused type wherein an aromatic nucleus is fused at two points to another nucleus such as found in naphthyl, anthranyl, azanaphthyl, etc. The polynuclear group can also be of the linked type wherein at least two nuclei (either mononuclear or polynuclear) are linked through bridging linkages to each other. These bridging linkages can be chosen from the group consisting of carbon-to-carbon single bonds, ether linkages, keto linkages, sulfide linkages, polysulfide linkages of 2 to about 6 sulfur atoms, sulfinyl linkages, sulfonyl linkages, alkylene linkages, alkylidene linkages, lower alkylene ether linkages, alkylene keto linkages, lower alkylene sulfur linkages, lower alkylene polysulfide linkages of 2 to about 6 carbon atoms, amino linkages, polyamino linkages and mixtures of such divalent bridging linkages. In certain instances, more than one bridging linkage can be present in Ar between two aromatic nuclei; for example, a fluorene nucleus having two benzene nuclei linked by both a methylene linkage and a covalent bond. Such a nucleus may be considered to have three nuclei but only two of them are aromatic. Normally, however, Ar will contain only carbon atoms in the aromatic nuclei per se (plus any aLkyl or alkoxy substituent present).

The number of aromatic nuclei, fused, linked or both, in Ar can play a role in determining the integer values of a and b in the above formula. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

In one embodiment, the organic material to be overbased is at least one phenol represented by the formula

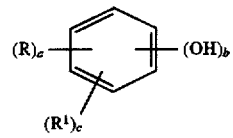

wherein R is a hydrocarbyl group of about 4 to about 400 carbon atoms; $R^1$ is a lower alkyl, lower alkoxyl, amino, aminomethyl, mercapto, amido, thioamido, nitro or halo group; a is a number in the range of 1 to about 3; b is 1 or 2; and c is 0 or 1. Usually R is derived from a homo- or interpolymer of monoolefins having from 2 to about 20 carbon atoms and is in a position para to the —OH group. In one embodiment, R is one or more of the above polyalkene groups. Specific examples of the substituent R are a polypropylene group of about 60 to about 340 carbons, a poly(ethylene/propylene) group of about 110 to about 260 carbons (equimolar monomer ratio), a poly(isobutene) group of about 70 to about 320 carbon atoms, and a poly(1-hexene/1-octene/1-decene) group of about 400 to about 750 carbons (equimolar monomer ratios).

Reaction Medium

The reaction medium used to prepare the overbased product (A) is a substantially inert, organic solvent/diluent for the organic material to be overbased. Examples include the alkanes and haloaanes of about 5 to about 18 carbons, alkyl ethers, alkanols, alkylene glycols, alkyl ethers of alkylene glycols and polyalkylene glycols, dibasic aLkanoic acid diesters, silicate esters, and mixtures of these. Specific examples include pentane, hexane, octane, cyclopentane, cyclohexane, isopropylcyclohexane, cyclooctane, halobenzenes such as mono- and polychlorobenzenes, mineral oils, isobutylether, methyl-n-amylether, methoxybenzene, p-methoxytoluene, methanol, ethanol, propanol, isopropanol, hexanol, alkylene glycols such as ethylene glycol and propylene glycol, diethyl ketone, methylbutyl ketone, dimethylformamide, dimethylacetamide, diisoctyl azelate, polyethylene glycols, polypropylene glycols, etc.

From the standpoint of availability, cost, and performance, the alkyl, cycloalkyl, and aryl hydrocarbons represent a useful class of reaction mediums. Liquid petroleum fractions represent another useful class. Included within these classes are benzenes and alkylated benzenes, cycloalkanes and alkylated cycloalkanes, cycloalkenes and alkylated cycloalkenes such as found in naphthene-based petroleum fractions, and the alkanes such as found in the paraffin-based petroleum fractions. Petroleum ether, naphthas, mineral oils, Stoddard Solvent, toluene, xylene, etc., and mixtures thereof are examples of economical sources of suitable inert organic liquids which can function as the reaction medium. Particularly useful are those containing at least some mineral oil as a component of the reaction medium.

Metal Base

The metal base used in preparing the overbased products is selected from the group consisting of alkali metals, alkaline-earth metals, titanium, zirconium, molybdenum, iron, copper, zinc, aluminum, mixture of two or more thereof, or basically reacting compounds thereof. The metal can be an alkali metal, alkaline-earth metal, zinc, aluminum, or a mixture of two or more thereof. Lithium, sodium, potassium, magnesium, calcium and barium are useful. The metal bases include alkoxides, nitrites, carboxylates, phosphites, sulfites, hydrogen sulfites, carbonates, hydrogen carbonates, borates, hydroxides, oxides, alkoxides, and amides of one or more of the above metals. The nitrites, carboxylates, phosphites, alkoxides, carbonates, borates, hydroxides and oxides are useful. The hydroxides, oxides, alkoxides and carbonates are especially useful.

Promoters

The promoters, that is, the materials which permit the incorporation of the excess metal into the overbased product, are also quite diverse and well known in the art as evidenced by the cited patents. These materials must be less acidic than the acidic material used in making the overbased products. A particularly comprehensive discussion of suitable promoters is found in U.S. Pat. Nos. 2,777,874; 2,695,910; and 2,616,904, which are incorporated herein by reference. These include the alcoholic and phenolic promoters which are preferred. The alcohol promoters include the alkanols of one to about 12 carbon atoms. Examples of the alcohols include methanol, ethanol, isopropanol, amyl alcohol, cyclohexanol, octanol, dodecanol, decanol, behenyl alcohol, ethylene glycol, diethylene glycol, triethylene glycol, monomethylether of ethylene glycol, trimethylene glycol, hexamethylene glycol, glycerol, pentaerythritol, benzyl alcohol, phenylethyl alcohol, sorbitol, nitropropanol, chloroethanol, aminoethanol, cinnamyl alcohol, allyl alcohol, and the like. Phenolic promoters include a variety of hydroxy-substituted benzenes and naphthalenes. A particularly useful class of phenols are the alkylated phenols, such as heptylphenol, octylphenol, nonylphenol, dodecyl phenol, propylene tetramer phenol, etc. Mixtures of various promoters can be used.

Acidic Material

Suitable acidic materials are also disclosed in the above cited patents, for example, U.S. Pat. No. 2,616,904. Included within the known group of useful acidic materials are carbamic acid, acetic acid, formic acid, boric acid, trinitromethane, $SO_2$, $CO_2$, sources of said acids, and mixtures thereof. $CO_2$ and $SO_2$, and sources thereof, are useful. Useful sources of $CO_2$ include urea, carbamates and ammonium carbonates. Useful sources of $SO_2$ include sulfurous acid, thiosulfuric acid and dithionous acid. $CO_2$ is especially preferred.

Preparation of the Overbased Material

In one embodiment, the overbased materials are prepared by contacting a mixture of the organic material to be overbased, the reaction medium, the metal base, and the promoter, with the acidic material. The temperature at which the acidic material contacts the remainder of the reaction mass depends to a large measure upon the promoter that is used. With a phenolic promoter, the temperature usually ranges from about 60° C. to about 300° C., and often from about 100° C. to about 200° C. When an alcohol or mercaptan is used as the promoter, the temperature usually does not exceed the reflux temperature of the reaction mixture and preferably does not exceed about 100° C. The exact nature of the resulting overbased material is not known. However, it can be adequately described for purposes of the present specification as a single phase homogeneous mixture of the reaction medium and (1) either a metal complex formed from the metal base, the acidic material, and the organic material to be overbased and/or (2) an amorphous metal salt formed from the reaction of the acidic material with the metal base and the organic material to be overbased. Thus, if mineral oil is used as the reaction medium, petrosulfonic acid as the organic material which is overbased, $Ca(OH)_2$ as the metal base, and carbon dioxide as the acidic material, the resulting overbased material can be described for purposes of this invention as an oil solution of either a metal containing complex of the acidic material, the metal base, and the petrosulfonic acid or as an oil solution of amorphous calcium carbonate and calcium petrosulfonate. Since the overbased materials are well known and as they are used merely as intermediates in the preparation of the boron-containing overbased materials (A) employed herein, the exact nature of these materials is not critical to the present invention.

Preparation of the Boron-Containing Overbased Materials

The boron-containing overbased material (A) can be prepared by contacting at least one overbased material with at least one boron compound. The boron compound can be boron oxide, boron oxide hydrate, boron trioxide, boron trifluoride, boron tribromide, boron trichloride, boron acids such as boronic acid (i.e., alkyl-B(OH)2 or aryl-$B(OH)_2$), boric acid (i.e., $H_3BO_3$), tetraboric acid (i.e., $H_2B_4O_7$), metaboric acid (i.e., $HBO_2$), boron anhydrides, and various esters of such boron acids. The use of complexes of boron trihalide with ethers, organic acids, inorganic acids, or hydrocarbons is a convenient means of introducing the boron reactant into the reaction mixture.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, benzyl alcohol, 2-butyl cyclohexanol, ethylene glycol, propylene glycol, trimethylene glycol, 1,3-butanediol, 2,4-hexanediol, glycerol, triethylene glycol, tripropylene glycol, phenol, naphthol, p-butylphenol, o,p-diheptylphenol, n-cyclohexylphenol, 2,2-bis-(phydroxyphenyl)-propane, o-chlorophenol, m-nitrophenol, 6-bromooctanol, and 7-keto-decanol. Lower alcohols, 1,2-glycols, and 1–3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The contacting of the overbased material with the boron compound can be effected using standard mixing techniques. The ratio of equivalents of the boron compound to equivalents of the overbased material can range up to about 40:1 or higher, and is typically in the range of about 0.05:1 to about 30:1, and is often in the range of about 0.2:1 to about 20:1. Equivalent ratios of about 0.5:1 to about 5:1, or about 0.5:1 to about 2:1, and often about 1:1 can be used. For purposes of this invention, an equivalent of a boron compound is based upon the number of moles of boron in said compound. Thus, boric acid has an equivalent weight equal to its molar weight, while tetraboric acid has an equivalent weight equal to one-fourth of its molar weight. An equivalent weight of an overbased material is based upon the number of equivalents of metal in said overbased material available to react with the boron. An equivalent of a metal is dependent upon its valence. Thus, one mole of a monovalent metal such as sodium provides one equivalent of the metal, whereas two moles of a divalent metal such as calcium are required to provide one equivalent of such metal. This number can be measured using standard techniques (e.g., titration using bromophenol blue as the indicator to measure total base number). Thus, an overbased material having one equivalent of metal available to react with the boron has an equivalent weight equal to its actual weight. An overbased material having two equivalents of metal available to react with the boron has an equivalent weight equal to one-half its actual weight.

The temperature can range from about room temperature up to the decomposition temperature of the reactants or desired products having the lowest such temperature, and is generally in the range of about 20° C. to about 200° C., and in one embodiment about 20° C. to about 150° C., and in one embodiment about 50° C. to about 150° C., and in one embodiment about 80° C. to about 120° C.

The contacting time is the time required to form the desired concentration of metal borate (e.g., sodium borate) in the boron-containing overbased material (A). This concentration can be measured using standard techniques (e.g., measurement of the concentration of dissolved solids when the boron compound is a solid, measurement of the water of reaction formed by the borating process, measurement of the displacement of acidic material, e.g., $CO_2$, from the overbased product (A), etc. Generally, the contacting time is from about 0.5 to about 50 hours, and often is from about 1 to about 25 hours, and in one embodiment about 1 to about 15 hours, and in one embodiment about 4 to about 12 hours.

The following Example A illustrates the preparation of a boron-containing overbased material (A) that is useful in accordance with the invention. Unless otherwise indicated in the examples as well as throughout the specification and the appended claims, all parts and percentages are by weight, all temperatures are in degrees centigrade, and all pressures are atmospheric.

EXAMPLE A-1

Part I:

A mixture of 1000 parts of alkyl benzene stilfonic acid in oil (24.8% oil), 771 parts of o-xylene, and 75.2 parts of polyisobutenyl (number average molecular weight=950) succinic anhydride is charged to a reaction vessel and the temperature is adjusted to 31.9° C. 87.3 parts magnesium oxide are added to the mixture. 35.8 parts of acetic acid are then added to the mixture. 31.4 parts of methanol and 59 parts of water are added to the mixture. The mixture is carbonated, the temperature of the mixture being 34.7°–40.2° C. 87.3 parts of magnesium oxide, 31.4 parts of methanol and 59 parts of water are added to the mixture, and the mixture is again carbonated. 87.3 parts of magnesium oxide, 31.4 parts of methanol and 59 parts of water are again added to the mixture, and the mixture is again carbonated. The total amount of carbon dioxide added is 232 parts. Methanol, o-xylene, and water are removed by atmospheric and vacuum flash stripping. The reaction mixture is cooled and filtered to provide the desired overbased magnesium sulfonate having a metal ratio of 14.7 and a diluent content of 42% by weight.

Part II:

A mixture of 5580 parts of the product from Part (1) and 2790 parts of toluene are charged to a reaction vessel. A slow nitrogen purge is started. The mixture is stirred and the temperature is adjusted to 45° C. 1395 parts of boric acid are added to the mixture over a period of 10 minutes. The mixture is heated from 45° C. to 96° C. over a period of 4.5 hours. The mixture is maintained at 80°–96° C. for 16 hours. The mixture is heated from 80° C. to 102° C. over a period of 3 hours. The mixture is then heated from 102° C. to 120° C. over a period of 5 hours. 310 parts of water distillate are removed. The toluene phase of the distillate is added back to the reaction vessel. The mixture is heated to 148° C. over a 5-hour period with full distillate removal. 296 parts of diatomaceous earth are added to the mixture and the mixture is filtered over a two-day period. The resulting product has a sulfur content of 1.29% by weight, a magnesium content of 8.28% by weight, and a boron content of 4.66% by weight.

(B) PHOSPHORUS ACID, ESTER OR DERIVATIVE

The lubricating compositions include at least one phosphorus acid, phosphorus acid ester or phosphorus acid salt or derivatives thereof. The phosphorus acids, esters, salts or derivatives thereof include compounds selected from the group consisting of phosphorus acid esters or salts thereof, phosphites, phosphorus containing amides, phosphorus-containing carboxylic acids or esters, phosphorus containing ethers and mixtures thereof. Included in this Section (13) are the phosphorus-containing acids listed above in Section (A).

The phosphorus acids include the phosphoric, phosphoric, phosphinic and thiophosphoric acids including dithiophosphoric acid as well as the monothiophosphoric, thiophosphinic and thiophosphoric acids. Included in this group are the phosphorus-containing acids described above under the subtitle "Phosphorus Containing Acids." Phosphoric acid is a preferred component of the compositions of this invention.

Eighty-five percent phosphoric acid is the preferred compound for addition to the fully-formulated ATF package and is included at a level of about 0.01–0.3 weight percent based on the weight of the ATF.

The phosphorus acid esters can be prepared by reacting a phosphorus acid or anhydride with an alcohol containing from 1 or about 3 carbon atoms up to about 30, or about 24, or about 12 carbon atoms. The phosphorus acid or anhydride is generally an inorganic phosphorus reagent such as phosphorus pentaoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

Alcohols used to prepare the phosphorus acid esters include butyl, amyl, hexyl, octyl, oleyl, and cresol alcohols. Higher synthetic monohydric alcohols of the type formed by Oxo process (e.g., 2-ethylhexyl), the Aldol condensation, or by organo aluminum catalyzed oligomerization of alpha-olefins (especially ethylene), followed by oxidation and hydrolysis, also are useful. Examples of some preferred monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols. Alfol 1218 is a mixture of synthetic, primary, straight-chain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Proctor & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5 % of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example is tricresol phosphate.

In one embodiment, the phosphorus acid ester is a monothiophosphoric acid ester or a monothiophosphate. Monothiophosphates are prepared by the reaction of a sulfur source and a hydrocarbyl or aryl substituted phosphites. The sulfur source may be elemental sulfur, a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638 which are incorporated herein by reference for their disclosure of monothiophosphates, sulfur sources for preparing monothiophosphates and the process for making monothiophosphates. A preferred monothiophosphate is triphenyl monothiophosphate.

Monothiophosphates may also be formed in the lubricant blend or functional fluid by adding a hydrocarbyl or aryl phosphite to a lubricating composition or functional fluid containing a sulfur source. The phosphite may react with the sulfur source under blending conditions (i.e., temperatures from about 30° C. to about 100° C. or higher) to form the monothiophosphate.

In one embodiment, the phosphorus acid is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecane oxide, styrene oxide, etc. Propylene oxide is preferred. The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reacting the same.

When the phosphorus acid esters are acidic, they may be reacted with an amine compound or metallic base to form the corresponding amine or metal salt. The salts may be formed separately and then the salt of the phosphorus acid ester is added to the lubricant or functional fluid composition. Alternatively, the salts may also be formed when the phosphorus acid ester is blended with other components to form the lubricating composition. The phosphorus acid ester could then form salts with basic materials which are in the lubricant or functional fluid composition such as basic nitrogen containing compounds (e.g., carboxylic dispersants) and overbased materials.

The amine salts of the phosphorus acid esters may be formed from ammonia, or a primary, secondary or tertiary amine, or mixtures thereof. Useful amines include those amines disclosed in U.S. Pat. No. 4,234,435 at Col. 1, line 4, to Col. 27, line 50; these pages being incorporated herein by reference.

The metal salts of the phosphorus acid esters are prepared by the reaction of a metal base with the phosphorus acid ester. The metal base may be in any convenient form such as oxide, hydroxide, carbonate, sulfate, borate, or the like. The metals of the metal base include Group IA, IIA, IB through VIIB and VIII metals (CAS version of the Periodic Table of the Elements). These metals include the alkali metals, alkaline earth metals and transition metals. In one embodiment, the metal is a Group IIA metal such as calcium or magnesium, Group IIB metal such as zinc, or a Group VIIB metal such as manganese. Preferably the metal is magnesium, calcium, manganese or zinc, more preferably magnesium, calcium or zinc, more preferably magnesium or zinc. Specific examples of useful metal bases include those described above under the heading "Metal Base".

The phosphorus acid ester can be a phosphite. In one embodiment, the phosphite is a di- or trihydrocarbyl phosphite. Each hydrocarbyl group can have from 1 to about 24 carbon atoms, or from 1 to about 18 carbon atoms, or from about 2 to about 8 carbon atoms. Each hydrocarbyl group may be independently alkyl, alkenyl or aryl. When the hydrocarbyl group is an aryl group, then it contains at least about 6 carbon atoms; and in one embodiment about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. In one embodiment each hydrocarbyl group is independently propyl, butyl, pentyl, hexyl, heptyl, oleyl or phenyl, more preferably butyl, oleyl or phenyl. Phosphites and their preparation are known and many phosphites are available commercially. Useful phosphites are dibutylhydrogen phosphite (DBPH), trioleyl phosphite and triphenyl phosphite with DBPH being a preferred component.

In one embodiment, the phosphorus acid derivative is a phosphorus-containing amide. The phosphorus-containing amides may be prepared by the reaction of a phosphorus acid (e.g., a dithiophosphoric acid as described above) with an unsaturated amide. Examples of unsaturated amides include acrylamide, N,N-methylene bisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorus acid ester is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula RCH=CH—O(O)CR$^1$ wherein R is a hydrogen or hydrocarbyl group having from 1 to about 30 carbon atoms, preferably hydrogen or a hydrocarbyl group having 1 to about 12, more preferably hydrogen, and R$^1$ is a hydrocarbyl group having 1 to about 30 carbon atoms, or 1 to about 12, or 1 to about 8. Examples of vinyl esters include vinyl acetate, vinyl 2ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula RO—(O)C—HC=CH—C(O)OR wherein each R is independently a hydrocarbyl group having 1 to about 18 carbon atoms, or 1 to about 12, or 1 to about 8 carbon atoms.

Examples of unsaturated carboxylic esters that are useful include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus acid is the reaction product of a phosphorus acid and a vinyl ether. The vinyl ether is represented by the formula R—CH$_2$=CH—OR$^1$ wherein R is hydrogen or a hydrocarbyl group having 1 to about 30, preferably 1 to about 24, more preferably 1 to about 12 carbon atoms, and R$^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

(C) BORATED EPOXIDE OR BORATED FATTY ACID ESTER OF GLYCEROL AND OTHER FRICTION MODIFIERS

The borated epoxides are made by reacting at least one of boric acid or boron trioxide with at least one epoxide having the formula

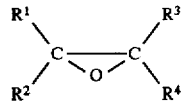

wherein each of R$^1$, R$^2$, R$^3$ and R$^4$ is hydrogen or an aliphatic radical, or any two thereof together with the epoxy carbon atom or atoms to which they are attached form a cyclic radical, said epoxide containing at least 8 carbon atoms. In one embodiment this reaction is conducted in the presence of a minor amount of a heel of a previously obtained oil-soluble boron-containing composition prepared by reacting the foregoing reagents.

The boric acid that can be used can be any of the various forms of boric acid, including metaboric acid ($HBO_2$), orthoboric acid ($H_3BO_3$) and tetraboric acid ($H_2B_4O_7$). Boric acid and orthoboric acid are preferred.

Each of the R groups in the above formula are most often hydrogen or an aliphatic group with at least one being an aliphatic group containing at least 6 carbon atoms. The term "aliphatic group" includes aliphatic hydrocarbon groups (e.g., hexyl, heptyl, octyl, decyl, dodecyl, tetradecyl, stearyl, hexenyl, oleyl), preferably free from acetylenic unsaturation; substituted aliphatic hydrocarbon groups including substituents such as hydroxy, nitro, carbalkoxy, alkoxy and alkylthio (especially those containing a lower alkyl group; i.e., one contaning 7 carbon atoms or less); and hetero atom-containing groups in which the hetero atoms may be, for example, oxygen, nitrogen or sulfur. The aliphatic groups are generally alkyl groups, and in one embodiment those containing from about 10 to about 20 carbon atoms. It is within the scope of the invention to use commercial mixtures of epoxides; for example, commercial mixtures of $C_{14-16}$ or $C_{14-18}$ epoxides and the like, wherein R$^1$ is a mixture of alkyl radicals having two less carbon atoms than the epoxide.

In one embodiment the borated epoxide (C) is a borated alpha-olefin epoxide having about 10 to about 20 carbon atoms, and in one embodiment about 14 to about 18 carbon atoms.

Also within the scope of the invention is the use of epoxides in which any two of the R groups together with the epoxy carbon atom or atoms to which they are attached, form a cyclic group, which may be alicyclic or heterocyclic. Examples include n-butylcyclopentene oxide, n-hexylcyclohexene oxide, methylenecyclooctene oxide and 2-methylene-3-n-hexyltetrahydrofuran oxide.

The borated epoxides may be prepared by merely blending the boric acid or boron trioxide and the epoxide and heating them at a temperature from about 80° C. to about 250° C., and in one embodiment from about 100° C. to about 200° C., for a period of time sufficient for reaction to take place. If desired, the reaction may be effected in the presence of a substantially inert, normally liquid organic diluent such as toluene, xylene, chlorobenzene, dimethylformamide or the like, but such diluents are usually unnecessary. During the reaction, water is frequently evolved and may be removed by distillation.

The molar ratio of the boric acid or boron trioxide to the epoxide is generally between about 1:0.25 and about 1:4. Ratios between about 1:1 and about 1:3 are useful.

In one embodiment it is advantageous to employ a catalytic amount of an alkaline reagent to facilitate the reaction. Suitable alkaline reagents include inorganic bases and basic salts such as sodium hydroxide, potassium hydroxide and sodium carbonate; metal alkoxides such as sodium methoxide, potassium t-butoxide and calcium ethoxide; heterocyclic amines such as piperidine, morpholine and pyridine; and aliphatic amines such as n-butylamine, di-n-hexylamine and tri-n-butylamine. Useful alkaline reagents are the aliphatic and heterocyclic amines and especially tertiary amines.

The preparation of a borated epoxide useful in this invention is illustrated by the following example.

EXAMPLE C-1

Part I:

A mixture of 1500 parts (6.25 moles) of 1-hexadecene oxide and 1 part of tri-n-butylamine is heated to 100°–110° C. under nitrogen, with stirring. Boric acid, 193 parts (3.13 moles), is added incrementally over 15 minutes. When boric acid addition is complete, the reaction mixture is heated to 185° C. as water is removed by distillation. When water evolution ceases, the mixture is filtered while hot, and the filtrate is allowed to cool to a waxy solid melting at 60°–65° C. This solid is the desired product; it contains 2.7% boron.

Part II:

A blend of 193 parts (3.13 moles) of boric acid, 1 part of tri-n-butylamine and a "heel" comprising 402 parts of the product prepared as in Part I is heated to 188° C., with stirring, as volatiles are removed by distillation. After 8.5 hours, 1500 parts (6.25 moles) of 1-hexadecene oxide is added over 5.5 hours at 186°–195° C., with stirring. Heating and stirring are continued for 2 hours as volatiles are removed. The material is then vacuum stripped and filtered at 93°–99° C. The filtrate is the desired product; it contains 2.1 % boron.

The borated fatty acid esters of glycerol are prepared by reacting a fatty acid ester of glycerol with a boric acid (e.g., boric acid, metaboric acid, orthoboric acid, tetraboric acid) with removal of the water of reaction. In one embodiment there is sufficient boron present such that each boron will react with from about 1.5 to about 2.5 hydroxyl groups present in the reaction mixture.

The reaction may be carried out at a temperature in the range of about 60° C. to about 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R—COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containg from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products tallow, palm oil, olive oil, peanut oil.

Friction modifiers are also well known to those skilled in the art. A useful list of friction modifiers are included in U.S. Pat. No. 4,792,410 which is incorporated herein by reference. U.S. Pat. No. 5,110,488 discloses metal salts of fatty acids and especially zinc salts and is incorporated herein by reference for said disclosures. Said list of friction modifiers includes:

fatty phosphites
fatty acid amides
fatty epoxides
borated fatty epoxides
fatty amines
glycerol esters
borated glycerol esters
alkoxylated fatty amines
borated alkoxylated fatty amines
metal salts of fatty acids
sulfurized olefins
fatty imidazolines
and mixtures thereof.

The preferred friction modifier is a borated fatty epoxide as previously mentioned as being included for its boron content. Friction modifiers are included in the compositions in the amounts of 0.1–10 weight percent and may be a single friction modifier or mixtures of two or more.

Friction modifiers also include metal salts of fatty acids. Preferred cations are zinc, magnesium, calcium, and sodium and any other alkali, or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

(D) THIOCARBAMATE

The thiocarbamates (D) are compounds represented by the formula $$R^1R^2N—C(X)S—(CR^3R^4)_aY$$

where $R^1$, $R^2$, $R^3$ and $R^4$ are independently hydrogen or hydrocarbyl groups, provided that at least one of $R^1$ or $R^2$ is a hydrocarbyl group; X is oxygen or sulfur; a is 1 or 2; and Y is a hydrocarbyl group, a hetero group (that is, a group attached through a heteroatom such as O, N, or S), an additional —SC(X)—$NR^1R^2$ group, or an activating group.

When a is 2, Y is an activating group. In describing Y as an "activating group," what is meant is a group which will activate an olefin to which it is attached toward nucleophilic addition by, e.g., $CS_2$ or COS derived intermediates. (This is reflective of the method by which this material is normally prepared, by reaction of an activated olefin with $CS_2$ and an amine.) The activating group Y can be, for instance, an ester group, typically but not necessarily a carboxylic ester group of the structure—$COOR^5$. It can also be an ester group based on a non-carbon acid, such as a sulfonic or sulfinic ester or a phosphoric or phosphinic ester. The activating group can also be any of the acids corresponding to the aforementioned esters. Y can also be an amide group, that is, based on the condensation of an acid group, preferably a carboxylic acid group, with an amine. In that case the —$(CR^3R^4)_aY$ group can be derived from acrylamide. Y can also be an ether group, —$OR^5$; a carbonyl group, —C(O)—, that is, an aldehyde or a ketone group; a cyano group, —CN, or an aryl group. In one embodiment Y is an ester group of the structure, —$COOR^5$, where $R^5$ is a hydrocarbyl group. $R^5$ can comprise 1 to about 18 carbon atoms, and in one embodiment 1 to about 6 carbon atoms. In one embodiment $R^5$ is methyl so that the activating group is —$COOCH_3$.

When a is 1, Y need not be an activating group, because the molecule is generally prepared by methods, described below, which do not involve nucleophilic addition to an activated double bond.

$R^3$ and $R^4$ can be, independently, hydrogen or methyl or ethyl groups. When a is 2, at least one of $R^3$ and $R^4$ is normally hydrogen so that this compound will be $R^1R^2N$—C(S)S—$CR^3R^4CR^3HCOOR^5$. In one embodiment most or all of the $R^3$ and $R^4$ groups are hydrogen so that the thiocarbamate will be $R^1R^2N$—C—(S)S=$CH_2$—$CH_2COOCH_3$. (These materials can be derived from methyl methacrylate and methylacrylate, respectively.) These and other materials containing appropriate activating groups are disclosed in greater detail in U.S. Pat. No. 4,758,362, which is incorporated herein by reference.

The substituents $R^1$ and $R^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. $R^1$ or $R^2$ are preferably alkyl groups of 1 to about 18 carbon atoms, and in one embodiment alkyl groups of 1 to about 8 carbon atoms. In one embodiment, both $R^1$ and $R^2$ are butyl groups. Thus, in one embodiment, the thiocarbamate (D) is S-carbomethoxyethyl-N,N-dibutyl dithiocarbamate which can be represented by the formula

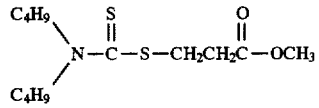

Briefly, these materials are prepared by reacting an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°–65° C.), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Y is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

U.S. Pat. Nos. 4,758,362 and 4,997,969 describe dithiocarbamate compounds and methods of making the same. These patents are hereby incorporated by reference for their disclosure of dithiocarbamate compounds and method of making the same.

Concentrates, Lubricating Compositions and Functional Fluids

The lubricant and functional fluid compositions of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids having enhanced antiwear properties.

The lubricants and functional fluid compositions of this invention employ an oil of lubricating viscosity which is generally present in a major amount (i.e. an amount greater than about 50% by weight). Generally, the oil of lubricating viscosity is present in an amount greater than about 60%, or greater than about 70%, or greater than about 80% by weight of the composition.

The natural oils useful in making the inventive lubricants and functional fluids include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicaboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl) silicate, hexyl-(4-methyl-2-pentoxy) disiloxane, poly(methyl) siloxanes, poly-(methylphenyl) siloxanes, etc.). Other synthetic lubricating oils include liquid esters of phosphorus-containing acids (e.g., tricresyl phosphate, trioctyl phosphate, diethyl ester of decane phosphoric acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the polyalpha-olefins are derived from monomers having from about 4 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt poly-alpha-olefins, 6 cSt, poly-alpha-olefins, 40 cSt poly-alpha-olefins and 100 cSt poly-alpha-olefins. Mixtures of mineral oils with the foregoing poly-alpha-olefins can be useful.

Generally, the lubricants and functional fluids of the present invention contain an effective amount of the inventive composition (i.e., components (A), (B), (C), and (D)) to provide said lubricants and functional fluids with enhanced antiwear properties. Normally the compositions of the present invention will be employed in such lubricants and functional fluids at a level in the range of about 0.01% to about 20% by weight, and in one embodiment about 0.05% to about 10% by weight of the total weight of the lubricant or functional fluid. The weight of substituents added to an oil to form a lubricant or functional fluid is given on a chemical basis. That is, the composition or component thereof is given on an oil-free basis.

The ranges for weight percents on an oil-free basis of components of the inventive composition are given below on the basis of total weight of the lubricant/functional fluid:

| | | |
|---|---|---|
| (A) | 0.05–3.0 | a boron-containing overbased material; |
| (B) | 0.05–2.5 | a phosphorus acid, ester or derivative; |
| (C) | 0.05–1.0 | a borated epoxide or borated fatty acid of glycerol; |
| (D) | 0.05–1.0 | a thiocarbamate. |

The invention also contemplates the use of lubricants and functional fluids containing other additives in addition to the compositions of this invention. Such additives include, for example, detergents and dispersants, corrosion-inhibiting agents, antioxidants, viscosity-index improving agents, extreme pressure (E.P.) agents, pour point depressants, friction modifiers, fluidity modifiers, seal swell agents, color stabilizers, dyes, anti-foam agents, etc.

The inventive lubricating compositions and functional fluids can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids. The most commonly used salts of such acids are those of sodium, potassium, lithium, calcium, magnesium, strontium and barium. These ash-producing detergents are described in greater detail above as being among the overbased materials used in preparing the borated overbased materials (A) of the invention.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in many U.S. Patents including U.S. Pat. Nos. 3,219,666; 4,234,435; and 4,938,881. These include the products formed by the reaction of a polyisobutenyl succinic anhydride of the type described above under the subtitle "Carboxylic Acids (a)" with an amine such as a polyethylene amine, as well as such polyisobutenyl succinic anhydride amine reaction products which have been post-treated with a boron compound such as boric acid.

(2) Reaction products of relatively high molecular weight aliphatic or alicyclic halides with amines, preferably oxyalkylene polyamines. These may be characterized as "amine dispersants" and examples thereof are described for example, in the following U.S. Pat. Nos.: 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. Patents are illustrative: U.S. Pat. Nos. 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitrites, epoxides, boron compounds, phosphorus compounds or the like. Exemplary materials of this kind are described in the following U.S. Pat. Nos.: 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly(oxyethylene)-substituted acrylates. These may be characterized as "polymeric dispersants" and examples thereof are disclosed in the following U.S. Pat. Nos.: 3,329,658; 3,449,250; 3,519,565; 3,666,730; 3,687,849; and 3,702,300.

The above-noted patents are incorporated by reference herein for their disclosures of ashless dispersants.

The inventive lubricating compositions and functional fluids can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Zinc salts are added to lubricating compositions to provide antiwear protection. The zinc salts are normally added as zinc salts of phosphorodithioic acids. Among the preferred compounds are zinc diisooctyl dithiophosphate and zinc dibenzyl dithiophosphate. Also included in lubricating compositions in the same weight percent range as the zinc salts to give antiwear/extreme pressure performance is dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference.

Specific oxidation-inhibitors that are useful include the mono- and di-paraalkylated (e.g., $C_9$) diphenylamines, hydroxythioether of t-dodecyl mercaptan and propylene oxide, and hydroxyethyl dodecyl sulfide. Specific corrosion-inhibitors that are useful include tolyltriazole and the dialkylated (e.g., $C_9$) sulfur-coupled dimercaptothiadiazoles.

The inventive lubricating compositions and functional fluids can contain one or more pour point depressants, viscosity-index improvers, color stabilizers, dyes and/or anti-foam agents. Pour point depressants are a particularly useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$ alpha-olefin. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Examples of commercially available pour point depressants and their chemical types are:

| Pour Point Depressant | Tradename | Source |
|---|---|---|
| 1. Polymethacrylates | Acryloid ® 154-70, 3004, 3007 | Rohm & Haas |
| | LZ ® 7749B, 7742 7748 | Lubrizol |
| | TC 5301, 10314 | Texaco |
| | Viscoplex ® 1-31, 1-330, 5-557 | Rohm GmbH |
| 2. Vinyl acetate/fumate or maleate copolymers | ECA 11039, 9153 | Exxon (Paramins) |
| 3. Styrene, maleate copolymers | LZ ® 6662 | Lubrizol |

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

In general, dispersant viscosity modifiers are polymers in which polar groups have been added or included. The polar groups, which are often basic in nature add dispersing properties to the viscosity modifiers.

Examples of commercially available VMs, DVMs and their chemical types are listed below. The DVMs are designated by a (D) after their number.

| Viscosity Modifiers | Tradename and Commercial Source | |
|---|---|---|
| 1. Polyisobutylenes | Indopol ® | Amoco |
| | Parapol ® | Exxon (Paramins) |
| | Polybutene ® | Chevron |
| | Hyvis ® | British Petroleum |
| 2. Olefin copolymers | Lubrizol ® 7060, 7065, 7067 | Lubrizol |
| | Paratone ® 8900, 8940, 8452 8512 | Exxon (Paramins) |
| | ECA-6911 | Exxon (Paramins) |
| | TLA 347E, 555(D), 6723(D) | Texaco |
| | Trilene ® CP-40, CP-60 | Uniroyal |
| 3. Hydrogenated styrene-diene copolymers | Shellvis ® 50, 40 | Shell |
| | LZ ® 7341, 7351, 7441 | Lubrizol |
| 4. Styrene, maleate copolymers | LZ ® 3702(D), 3715(D), 3703(D) | Lubrizol |
| 5. Polymethacrylates | Acryloid ® 702, 954(D), 985(D), 1019, 1265(D) | Rohm & Haas |
| | TLA 388, 407, 5010(D), 5012(D) | Texaco |
| | Viscoplex ® 4-950(D), 6-500(D), 5151(D) | Rohm GmbH |
| 6. Olefin-graft-polymethacrylate polymers | Viscopolex ® 2-500, 2-600 | Rohm GmbH |
| 7. Hydrogenated polyisoprene star polymers | Shellvis ® 200, 260 | Shell |

Recent summaries of viscosity modifiers can be found in U.S. Pat. Nos. 5,157,088, 5,256,752 and 5,395,539 which are herein incorporated by reference for disclosure pertinent to this invention.

A specific preferred viscosity-index improver that can be used is Viscoplex 5151 which is a product of Rohm GMBH identified as a polymethacrylate. In the preferred mode of this invention, a dispersant viscosity modifier is selected which provides the compositions of the invention with superior shear stability. For instance, when Visoplexe® 5151 is used in the formulations presented herein the kinematic 100° C. viscosity dropped from 7.52 cSt to only 7.41 cSt after 40 passes in the FISST apparatus used in ASTM D5275.

The shear stable dispersant viscosity modifiers of this invention are selected so that their inclusion in a formulated automatic transmission fluid gives a formulation wherein kinematic viscosity at 100° C. does not drop more than 10% when viscosity is determined after 40 passes in the FISST apparatus and in ASTM 5275.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

An example of a fluidity modifier is Hydrocal-38 which is a product Calumet identified as a refined naphthenic oil. An example of a seal swell agent is polyisobutyl-o-aminophenol. Emery 2971, which is a product of Emery identified as a mixture of di- and tri-decyladipate, can function as both a fluidity modifier and a seal swell agent. Ethomeen T/12, which is a product of Armak identified as bis(2-hydroxyethyl) tallowamine, is useful as a friction modifier.

Each of the foregoing additives, when used, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid.

The lubricant compositions of the present invention may be in the form of a grease in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantities of thickening agents and other additive components to provide desirable properties.

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmitic acid, myristic acid, cottonseed oil acids, and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

In one embodiment, thickening agents employed in the grease compositions are essentially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surface-active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5% to about 30%, and in one embodiment from about 3% to about 15% by weight of the total grease composition.

Components (A), (B), (C) and (D) of the inventive compositions of this invention can be added directly to the lubricant or functional fluid. In one embodiment, however, they are diluted with a substantially inert, normally liquid organic diluent such as mineral oil, naphtha, benzene, toluene or xylene, to form an additive concentrate. These concentrates usually contain from about 10% to about 90% by weight of the inventive compositions (that is, (A), (B), (C) and (D)) and may contain, in addition, one or more other additives known in the art or described hereinabove. The remainder of the concentrate is the substantially inert normally liquid diluent.

EXAMPLES

The following Examples are provided in Table I below for the purpose of illustrating specific embodiments of the invention. Each of these examples consists of automatic transmission fluid formulations that are characterized by enhanced antiwear properties. Test results involving the following antiwear tests are also disclosed for representative compositions of each of these formulations in Table II: (1) Vane Pump Wear Test (ASTM D-2882); (2) Four-Ball Wear Test (ASTM D4172); Falex EP Test (ASTM D-3233); Timken Wear Test (ASTM D-2782); and FZG Gear Wear Test. The disclosed test results demonstrate the enhanced antiwear properties of the inventive compositions. Column 4 of Table II represents a commercially-available ATF which is inferior in test results to those of this invention. The weight percent of each component added to a base oil is on an oil-free basis and is based on the weight of the lubricant/functional fluid.

The ATFs of this invention are blended to have Brookfield viscosity values at −40° C. of less than 20,000 cP. Preferably the −40° C. viscosity ranges from about 8,000 cP to about 13,000.

The ATFs of this invention are blended so that the 100° C. kinematic viscosity ranges for the fluid range between about 6 and 8 cSt. The preferred 100° C. kinematic viscosity range is roughly between 6.5 and 8.

The antiwear properties of the fully formulated ATFs which meet the low viscosity parameters outlined above are accomplished by use of components listed herein and shown in examples 1–3 and 5–7. Polysulfide compositions as disclosed in Schwind U.S. Pat. No. 5,403,501 are specifically excluded from this invention. Polysulfides as disclosed in '501 are too corrosive for use in ATFs, and would be detrimental to an ATF's passing a copper corrosion test. The U.S. Pat. No. 5,403,501, is hereby incorporated by reference for its disclosure of polysulfide materials excluded from this invention.

Table I reveals that both (B), a phosphorus acid, ester or derivative thereof and (D) a thiocarbamate are included in the three listed compositions. Preferred embodiments for component (B) are listed below together with their weight percent ranges on an oil-free basis in lubricating fluids.

(B)-1Dibutyl hydrogen phosphite 0.05–2%

(B)-2 Triphenyl monothiophosphate 0.01–2%

(B)-3 85% phosphoric acid 0.01–1.5%

In another preferred embodiment, compounds (B)-1 and (B)-2 may be used with (D) a thiocarbamate. Thus, compositions may embody (D) with (13) as shown in Table I where (B) may encompass (B)-1 through (B)-3 shown above, (D) may also be used in combination with only (B)-1 and (B)-2.

In still another preferred embodiment (B) may be used without (D) and in this instance (B) may encompass (B)-1 through (B)-3.

Table III lists compositions 5–7. Composition 5 corresponds to a lubricating composition with (D) and (B)-1 through (B)-3. Composition 6 corresponds to a lubricating composition without (D) but with (B)-1 through (B)-3. Composition 7 corresponds to a composition having (D) with (B)-1 and (B)-2.

Further, the '501 patent discloses only SAE 90 as the base oil in its examples which are used in determining antiwear properties of the compositions. SAE 90 oil cannot meet the 100° C. kinematic viscosity range or −40° C. Brookfield viscosity range of the formulated ATFs of this invention.

TABLE I

| | 1 | 2 | 3 |
|---|---|---|---|
| Base oil (75% 6 cSt, poly-α-olefinic + 25% 4 cSt. poly-α-olefin), wt. % | about 78–82 | — | — |
| Base oil (85% 4 cst. Poly-α-olefin + 15% 40 cSt. poly-α-olefin) | — | about 78–82 | — |
| Base oil (50% 90 N mineral oil + 50% 4 cSt. poly-α-olefin) | — | — | about 78–82 |
| (A) Borated overbased magnesium sulfonate of Example A-1, wt. % | 0.05–.20 | 0.05–.2 | 0.05–0.2 |
| (B) Phophorus acid, ester or derivative thereof wt. % | 0.2–0.6 | 0.2–0.6 | 0.2–0.5 |
| (C) Borated C16-olefin epoxide wt. % | 0.15–0.3 | 0.15–0.3 | 0.15–0.3 |
| (D) A thiocarbamate wt. % | 0.05 | 0.05 | 0.05 |
| Reaction products of polyisobutenyl succinic anhydride and polyamines, wt. % | 1.75–3.0 | 1.75–3.0 | 1.75–3.0 |
| Borated reaction product of polyisobutenyl succinic anhydride and polyethylene amines, wt. % | 0.35–0.6 | 0.35–0.6 | 0.35–0.6 |
| Friction modifiers wt. % | 0.15–0.25 | 0.05–.15 | 0.05–0.15 |
| Oxidation Inhibitors | 0.75–1.25 | 0.75–1 | 0.75–1 |
| Viscosity improver wt. % | 0–4 | 2–4 | 3–7.5 |
| Tolytriazole wt. % | 0–0.03 | 0–0.03 | 0.01–0.03 |
| Di-alkylated ($C_9$) sulfur coupled dimercaptothiadiazole wt. % | 0–0.5 | 0–0.5 | 0.01–0.5 |

TABLE II

| | 1 | 2 | 3 | 4 |
|---|---|---|---|---|
| Vane Pump Wear Test, wt. loss | | | | |
| (ASTM D-2882 at 80° C., 6.9 MPa), mg. | 0.2 | 1.6 | 14.0 | 8.0 |
| (ASTM D-2882 at 150° C., 6.9 MPa), mg. | 2.9 | 9.7 | 14.8 | >1,000 |
| Four-Ball Wear Test, 40 Kg. load, 2 hrs. (ASTM D-4172) Average Wear Scar Diameter, mm. | | | | |
| 1200 RPM, 100° C. | 0.38 | 0.41 | 0.43 | 0.57 |
| 1200 RPM, 150° C. | 0.42 | 0.47 | 0.49 | 0.63 |
| Average Wear Scar Diameter, mm. | | | | |
| 600 RPM, 100° C. | 0.35 | 0.36 | 0.34 | 0.48 |
| 600 RPM, 150° C. | 0.37 | 0.39 | 0.41 | 0.54 |
| Falex EP Test (ASTM D-3233) | | | | |
| No seizure load at 100° C., 1 min., lbs. | 1750 | 1750 | 1000, 1750 | 750, 1000 |
| No seizure load at 150° C., 1 min., lbs. | 1000 | 1000 | 1250 | 500, 750 |
| Timken Wear Test, burnish width, mm. | 0.58 | 0.43 | 0.75, 0.36 | 1.44 |
| | No scoring | No scoring | No Scoring | (Scoring) |
| | 0.62 | 0.49 | 0.7, 0.46 | — |
| (ASTM D-2782) 9 lb. load, 100° C., 10 min. | No Scoring | No Scoring | | |
| FZG Gear Wear Test, Load Stage Pass | | | | |
| 1450 RPM, 15 min. at 100° C. start temp. | >12 | >12 | 11 | 10 |
| 1450 RPM, 15 min. at 150° C. start temp. | 11, >12 | 11 | 10 | 8 |

TABLE III

| | 5 | 6 | 7 |
|---|---|---|---|
| Base oil (75% 6 cSt. poly-alpha olefin + 25% 4 cSt. poly-alpha olefin), wt. % | 79.83 | — | |
| Base oil (50% 100 N mineral oil + 50% 4 cSt. poly-alpha olefin) | — | — | |
| Base oil (50% 90 N mineral oil + 50% 4 cSt. poly-alpha olefin) | — | 79.60 | 78.93 |
| (A) Borated overbased magnesium sulfonate of Example A-1, wt. % | 0.25 | 0.25 | 0.25 |
| (B)-1 Dibutyl hydrogen phosphite, wt. % | 0.25 | 0.25 | 0.25 |

TABLE III-continued

| | 5 | 6 | 7 |
|---|---|---|---|
| (B)-2 Triphenyl monothiophosphate, wt. % | 0.10 | 0.10 | 0.10 |
| (B)-3 Phosphoric acid (85%), wt. % | 0.04 | 0.04 | — |
| (C) Borated $C_{16}$ alpha olefin epoxide, wt. % | 0.25 | 0.20 | 0.25 |
| (D)S-carbomethoxyethyl-N,N-dibutyl-dithiocarbamate, wt. % | 0.20 | — | 0.20 |
| Reaction product of polyisobutenyl succinic anhydride and polyethylene amines, wt. % | 4.00 | 4.00 | 4.0 |
| Borated reaction product of polyisobutenyl succinic anhydride and polyethylene amines, wt. % | 0.50 | 0.50 | 0.5 |
| $C_9$ mono- and di-paraalkylated diphenylamine diluted with oil (16% oil), wt. % | 0.50 | 0.50 | 0.5 |
| Hydroxy thioether of t-dodecyl mercaptan and propylene oxide, wt. % | 0.50 | 0.35 | 0.5 |
| Tolyltriazole, wt. % | 0.03 | — | 0.02 |
| Di-alkylated ($C_9$) sulfur coupled dimercapto thiadiazole, wt. % | — | — | 0.03 |
| Ethomeen T/12 (product of Armak identified as bis(2-hydroxyethyl)tallowamine), wt. % | 0.12 | 0.12 | 0.12 |
| Hydroxyethyl dodecyl sulfide, wt. % | — | 0.15 | — |
| Polyisobutyl-o-aminophenyl, wt. % | 1.80 | 0.60 | 0.60 |
| Emery 2971 (product of Emery identified as di-, tri-decyladipate), wt. % | 5.00 | — | — |
| Hydrocal-38 (product of Calumet identified as refined naphthenic oil), wt. % | — | 3.00 | 3.00 |
| Naphthalene alkylated with polychlorinated paraffin and $C_{16}$–$C_{18}$ alpha olefin, wt. % | — | 0.30 | 0.30 |
| Viscoplex 5151 (product of Rohm GMBH identified as a polymethacrylate), wt. % | 6.50 | 10.00 | 10.30 |
| Diluent oil, wt. % | 0.06 | 0.04 | — |
| Red dye, wt. % | 0.025 | 0.025 | — |
| Silicone antifoam agent, wt. % | 0.042 | 0.042 | — |
| TEST RESULTS | | | |
| Vane Pump Wear Test, wt. loss, | | | |
| (ASTM D-2882 at 80° C., 6.9 MPa), mg. | 0.5 | 12.3,4.9 | 14.0 |
| (ASTM D-2882 at 150° C., 6.9 MPa), mg. | 9.4 | 10.6,13.7 | 14.8 |
| Four-Ball Wear Test, 40 Kg. load, 2 hrs. (ASTM D-4172) Average Wear Scar Diameter, mm. | | | |
| 1200 RPM, 100° C. | 0.42 | 0.54 | 0.43 |
| 1200 RPM, 150° C. | 0.44 | 0.56 | 0.49 |
| Average Wear Scar Diameter, mm. | | | |
| 600 RPM, 100° C. | 0.36 | 0.38 | 0.34 |
| 600 RPM, 150° C. | 0.38 | 0.41 | 0.41 |
| Falex EP Test (ASTM D-3233) | | | |
| No seizure load at 100° C., 1 min., lbs. | 1500, 2000 | 1000 | 1000 |

TABLE III-continued

| | 5 | 6 | 7 |
|---|---|---|---|
| No seizure load at 150° C., 1 min., lbs. | 1000 | 1000 | 1250 |
| Timken Wear Test, burnish width, mm. (ASTM D-2782) | | | |
| 9 lb. load, 100° C., 10 min. | 0.52 | 0.74, 0.8, 0.33 | 0.75, 0.36 |
| | No Scoring | No Scoring | No Scoring |
| 9 lb. load, 150° C., 10 min. | 0.58 | 0.82, 0.68, 0.49 | 0.7, 0.40 |
| | No Scoring | No Scoring | No Scoring |
| FZG Gear Wear Test, Load Stage Pass | | | |
| 1450 RPM, 15 min. at 100° C. start temp. | 10, >12 | 10, >12 | 10 |
| 1450 RPM, 15 min. at 150° C. start temp. | 8, 9 | 11, 11 | 11 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An automatic transmission fluid comprising:

(A) a boron-containing overbased material;

(B) -1 a phosphite;

(B) -2 a monothiophosphate;

(C) a borated friction modifier;

(D) a thiocarbamate;

(E) a shear stable dispersant viscosity modifier; and (F) an oil of lubricating viscosity in an amount greater than 50% by weight of said composition;

wherein said composition is free of polysulfides, and wherein said composition has a −40° C. Brookfield viscosity of less than about 15,000 cP.

2. The composition according to claim 1, wherein (B) further comprises phosphoric acid.

3. A composition according to claim 1, wherein (A) is a borated overbased magnesium sulfonate.

4. A composition according to claim 1, wherein said borated friction modifier is selected from the group consisting of (a) borated epoxides;

(b) borated fatty acid esters of glycerol;

(c) borated alkoxylated fatty amines or mixtures thereof.

5. A composition according to claim 1, wherein said borated friction modifier is a borated epoxide.

6. A composition according to claim 1, wherein said phosphite is a dialkylhydrogen phosphite and said monothiophosphate is a triaryl monothiophosphate.

7. The composition recited in claim 1, wherein said fluid has a 100° C. kinematic viscosity of less than 8.5 cSt.

8. The composition recited in claim 7, wherein the 100° C. kinematic viscosity value of said fluid is reduced less than 10% when determined after 40 passes through the FISST apparatus used in ASTM 5275.

9. An automatic transmission fluid comprising:

(A) a boron-containing magnesium sulfonate;

(B)-1 a dialkyl hydrogen phosphite;

(B)-2 a triarylmonothiophosphate;

(B)-3 phosphoric acid;

(C) a borated epoxide having about 10 to about 20 carbon atoms;

(E) a shear stable dispersant viscosity modifier; and (F) an oil of lubricating viscosity in an amount greater than 50% by weight of said composition;

wherein said composition is free of polysulfides, and wherein said composition has a −40° C. Brookfield viscosity of less than about 15,000 cP.

10. A composition according to claim 9, wherein (B)-1 is dibutyl hydrogen phosphite and (B)-2 is triaryl monothio phosphate.

11. The compositions as recited in claims 1 and 9, wherein said compositions further comprise a dispersant or a borated dispersant or mixtures thereof.

12. A composition as recited in claim 9, said composition further comprising (D), a thiocarbamate.

13. A composition according to claims 1 and 10, wherein (D) is a thiocarbamate of formula

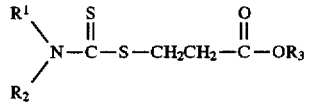

14. A composition according to claims 1 and 12, wherein (D) is S-carbomethoxyethyl-N,N-dibutyl dithiocarbamate.

15. The composition recited in claim 9, wherein said fluid has a 100° C. kinematic viscosity of less than 8.5 cSt.

16. The composition recited in claim 15, wherein the 100° C. kinematic viscosity value of said fluid is reduced less than 10% when determined after 40 passes through the FISST apparatus used in ASTM 5275.

* * * * *